US009457395B2

(12) United States Patent
Gotlund

(10) Patent No.: US 9,457,395 B2
(45) Date of Patent: Oct. 4, 2016

(54) SPLIT WEDGE AND METHOD FOR MAKING SAME

(71) Applicant: Nevis Industries LLC, Wilmington, DE (US)

(72) Inventor: Erik L. Gotlund, Green Oaks, IL (US)

(73) Assignee: Nevis Industries LLC, Wilmington, DE (US)

( * ) Notice: Subject to any disclaimer, the term of this patent is extended or adjusted under 35 U.S.C. 154(b) by 0 days.

(21) Appl. No.: 14/802,363

(22) Filed: Jul. 17, 2015

(65) Prior Publication Data

US 2016/0031001 A1 Feb. 4, 2016

Related U.S. Application Data

(63) Continuation of application No. 13/828,074, filed on Mar. 14, 2013, now Pat. No. 9,114,814.

(60) Provisional application No. 61/715,010, filed on Oct. 17, 2012.

(51) Int. Cl.

| | |
|---|---|
| ***B22C 9/00*** | (2006.01) |
| ***B22C 9/22*** | (2006.01) |
| ***B61F 5/12*** | (2006.01) |
| ***B22C 9/02*** | (2006.01) |

(Continued)

(52) U.S. Cl.

CPC . *B22C 9/22* (2013.01); *B22C 9/02* (2013.01); *B22C 9/108* (2013.01); *B22D 25/02* (2013.01); *B22D 25/06* (2013.01); *B61F 5/06* (2013.01); *B61F 5/122* (2013.01)

(58) Field of Classification Search

CPC ..... B61F 5/06; B61F 5/122; B22C 9/02; B22C 9/108; B22D 25/02; B22D 25/06

See application file for complete search history.

(56) References Cited

U.S. PATENT DOCUMENTS

| | | | |
|---|---|---|---|
| 2,688,412 | A | 9/1954 | Kulieke |
| 2,997,755 | A | 8/1961 | Olson |

(Continued)

FOREIGN PATENT DOCUMENTS

| | | | |
|---|---|---|---|
| CN | 201102057 | Y | 8/2008 |
| CN | 101402131 | A | 4/2009 |

(Continued)

OTHER PUBLICATIONS

Steel Castings Handbook, Sixth Edition, 1995, Steel Founders' Society of America; 4 pages.

(Continued)

*Primary Examiner* — Jason C Smith

(74) *Attorney, Agent, or Firm* — Banner & Witcoff, Ltd.

(57) ABSTRACT

A method of manufacturing a friction wedge of a rail car includes forming, in drag and cope portions of a mold, at least one cavity that defines at least some exterior features of at least one friction wedge. At least one core is inserted into the drag portion adjacent to the cavity. The core includes at least one surface configured to define a column face of the friction wedge. Rigging is formed in the drag and cope portion of the mold. The rigging includes a down sprue, at least one ingate, and at least one runner for directing molten material to the cavity. Molten material is poured into the mold to form the friction wedge casting. The friction wedge casting is removed from the mold. Rigging is removed from the friction wedge casting and the friction wedge casting is finished.

21 Claims, 7 Drawing Sheets

(51) Int. Cl.

| | |
|---|---|
| ***B22C 9/10*** | (2006.01) |
| ***B22D 25/02*** | (2006.01) |
| ***B22D 25/06*** | (2006.01) |
| ***B61F 5/06*** | (2006.01) |

(56) References Cited

U.S. PATENT DOCUMENTS

| | | | | |
|---|---|---|---|---|
| 4,143,701 | A | 3/1979 | Oshinsky et al. | |
| 5,479,981 | A | 1/1996 | Kim | |
| 5,511,489 | A * | 4/1996 | Bullock | B61F 5/122 105/198.2 |
| 5,555,817 | A * | 9/1996 | Taillon | B61F 5/122 105/198.2 |
| 5,875,721 | A * | 3/1999 | Wright | B61F 5/12 105/198.2 |
| 5,943,961 | A * | 8/1999 | Rudibaugh | B61F 5/122 105/198.2 |
| 6,269,752 | B1 * | 8/2001 | Taillon | B61F 5/122 105/198.2 |
| 6,374,749 | B1 * | 4/2002 | Duncan | B61F 5/122 105/198.5 |
| 6,425,334 | B1 * | 7/2002 | Wronkiewicz | B61F 5/122 105/198.2 |
| 6,588,490 | B2 | 7/2003 | Rommel et al. | |
| 6,688,236 | B2 | 2/2004 | Taillon | |
| 6,895,866 | B2 | 5/2005 | Forbes | |
| 6,971,319 | B2 * | 12/2005 | Bowden | B61F 5/32 105/198.5 |
| 7,174,837 | B2 * | 2/2007 | Berg | B61F 5/122 105/197.05 |
| 7,302,994 | B2 | 12/2007 | Mautino et al. | |
| 7,389,731 | B2 * | 6/2008 | Rudibaugh | B61F 5/34 105/198.5 |
| 7,699,008 | B2 | 4/2010 | Forbes | |
| 8,113,126 | B2 * | 2/2012 | Forbes | B61F 5/06 105/157.1 |
| 8,136,456 | B2 | 3/2012 | Sammartino | |
| 8,869,709 | B2 * | 10/2014 | East | B61F 5/50 105/198.2 |
| 2002/0007931 | A1 | 1/2002 | Crafton et al. | |
| 2005/0022689 | A1 * | 2/2005 | Forbes | B61F 5/122 105/198.2 |
| 2005/0184021 | A1 | 8/2005 | Mautino et al. | |
| 2009/0289024 | A1 | 11/2009 | Nibouar et al. | |
| 2010/0162919 | A1 * | 7/2010 | Aitken | B61F 5/308 105/198.2 |
| 2011/0036264 | A1 * | 2/2011 | Sammartino | B61F 5/122 105/198.2 |
| 2013/0047882 | A1 * | 2/2013 | Sun | B61F 5/122 105/198.2 |
| 2014/0102330 | A1 * | 4/2014 | Gotlund | B61F 5/122 105/198.2 |

FOREIGN PATENT DOCUMENTS

| | | | |
|---|---|---|---|
| GB | 743098 | A | 1/1956 |
| GB | 2292899 | A | 3/1996 |
| GB | 2300611 | A | 11/1996 |
| JP | 2004017099 | A | 1/2004 |
| JP | 2004025210 | A | 1/2004 |
| WO | 2009142748 | A1 | 11/2009 |
| WO | 2009142750 | A1 | 11/2009 |
| WO | 2009142757 | A1 | 11/2009 |
| WO | 2011082348 | A1 | 7/2011 |

OTHER PUBLICATIONS

May 30, 2011—(WO) International Search Report and Written Opinion—App. PCT/US2010/062574.

Aug. 14, 2011—(WO) International Search Report and Written Opinion—App. PCT/US2012/037980.

Jan. 16, 2013—(WO) International Search Report and Written Opinion—App. PCT/US2012/048002.

Jul. 7, 2015—(MX) Office Action—App. MX/A/2015/004711.

* cited by examiner

SPLIT WEDGE AND METHOD FOR MAKING SAME

CROSS-REFERENCE TO RELATED APPLICATIONS

This application is a continuation of pending U.S. patent application Ser. No. 13/828,074 filed Mar. 14, 2013 entitled "Split Wedge and Method for Making Same", which claims priority to U.S. Provisional Application No. 61/715,010 filed Oct. 17, 2012 entitled "Split Wedge and Method for Making Same", which are incorporated by reference herein in their entirety.

BACKGROUND

Railway cars typically consist of a rail car that rests upon a pair of truck assemblies. The truck assemblies include a pair of side frames and wheelsets connected together via a bolster and damping system. The damping system includes a set of friction wedge dampers. The car rests upon the center bowl of the bolster, which acts as a point of rotation for the truck system. The car body movements are reacted through the springs and friction wedge dampers, which connect the bolster and side frames. The side frames include pedestals that each define a jaw into which a wheel assembly of a wheel set is positioned using a roller bearing adapter.

The components may be formed via various casting techniques. The most common technique for producing these components is through sand casting. Sand casting offers a low cost, high production method for forming complex hollow shapes such as side frames and bolsters. In a typical sand casting operation, (1) a mold is formed by packing sand around a pattern, which generally includes the gating system; (2) The pattern is removed from the mold; (3) cores are placed into the mold and the mold is closed; (4) the mold is filled with hot liquid metal through the gating; (5) the metal is allowed to cool in the mold; (6) the solidified metal referred to as raw casting is removed by breaking away the mold; (7) and the casting is finished and cleaned through the use of grinders, welders, heat treatment, and machining In a sand casting operation, the mold is created using sand as a base material, mixed with a binder to retain the shape. The mold is created in two halves -cope and drag which are separated along the parting line. The sand is packed around the pattern and retains the shape of the pattern after it is extracted from the mold. Draft angles of 3 degrees or more are machined into the pattern to ensure the pattern releases from the mold during extraction. In some sand casting operations, a flask is used to support the sand during the molding process through the pouring process. Cores are inserted into the mold and the cope is placed on the drag to close the mold.

When casting a complex or hollow part, cores are used to define the hollow interior, or complex sections that cannot otherwise be created with the pattern. These cores are typically created by molding sand and binder in a box shaped as the feature being created with the core. These core boxes are either manually packed, or the core is manufactured using a core blower or shell machines. The cores are removed from the box, and placed into the mold. The cores are located in the mold using core prints to guide their placement. The core prints also prevent the core from shifting while the metal is poured. Additionally, chaplets may be used to support or restrain the movement of cores, and fuse into the base metal during solidification.

The mold typically contains the gating system, which provides a path for the molten metal, and controls the flow of metal into the cavity. This gating consists of a sprue, which controls metal flow velocity, and connects to the runners. The runners are channels for metal to flow through the gates into the cavity. The gates control flow rates into the cavity, and prevent turbulence of the liquid.

After the metal has been poured into the mold, the casting cools and shrinks as it approaches a solid state. As the metal shrinks, additional liquid metal must continue to feed the areas that contract, or voids will be present in the final part. In areas of high contraction, risers are placed in the mold to provide a secondary reservoir to be filled during pouring. These risers are the last areas to solidify, and thereby allow the contents to remain in the liquid state longer than the cavity of the part being cast. As the contents of the cavity cool, the liquid metal in the risers feeds the areas of contraction, ensuring a solid final casting is produced. Risers that are open on the top of the cope mold can also act as vents for gases to escape during pouring and cooling.

In the various casting techniques, different sand binders are used to allow the sand to retain the pattern shape. These binders have a large effect on the final product, as they control the dimensional stability, surface finish, and casting detail achievable in each specific process. The two most typical sand casting methods include (1) green sand, consisting of silica sand, organic binders and water; and (2) chemical or resin binder material consisting of silica sand and fast curing chemical binding adhesives such as phenolic urethane. Traditionally, side frames and bolsters have been created using the green sand process, due to the lower cost associated with the molding materials. While this method has been effective at producing these components for many years, there are disadvantages to this process.

Friction wedge dampers produced via the green sand operation described above have several problems. First, the relatively large draft angles required in the patterns result in corresponding draft angles in the friction wedges which may be ground down to meet customer specifications. This is especially problematic on the column face of friction wedges. Second, obtaining flat and smooth surfaces on critical portions of the friction wedges typically requires extra finishing steps, such as grinding of surfaces. This can result in inconsistent final product dimensions, increased finishing time, or scrapping of the component if outside specified dimensions. Other problems with these casting operations will become apparent upon reading the description below.

BRIEF SUMMARY

A first aspect of the application is to provide a method of manufacturing a friction wedge for a rail car. The method includes forming, in drag and cope portions of a mold, at least one cavity that defines at least some exterior features of at least one friction wedge. At least one core is inserted into the mold adjacent to the cavity. The core includes at least one surface configured to define a column face of the friction wedge. Rigging is formed in the drag and cope portion of the mold. The rigging includes a down sprue, at least one ingate, and at least one runner for directing molten material to the cavity. Molten material is poured into the mold to form the friction wedge casting. The friction wedge casting is removed from the mold and the rigging is removed.

A second aspect of the application is to provide a friction wedge for a rail car with a column face that, prior to finishing operations, is substantially flat with a surface finish less than 500 micro-inches RMS and chamfered edges with a radius of about 0.30 inches.

A third aspect of the application is to provide a friction wedge for a rail car that includes a column face with substantially flat top and bottom regions and a concave middle region. The maximum distance between a plane within which the top and bottom flat regions are disposed and an apex of the concave middle region is between 0.020 and 0.060 inches.

A fourth aspect of the application is to provide a friction wedge for a rail car that includes a column face with a recessed portion.

A fifth aspect of the application is to provide a friction wedge for a rail car having an acicular gray iron microstructure that comprises Bainite, Martensite, Austenite, Carbide, and no more than about 5% Pearlite.

A sixth aspect of the application is to provide a friction wedge for a rail car having a hardness of between 420-520 BHN.

Other features and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

Figure 1:
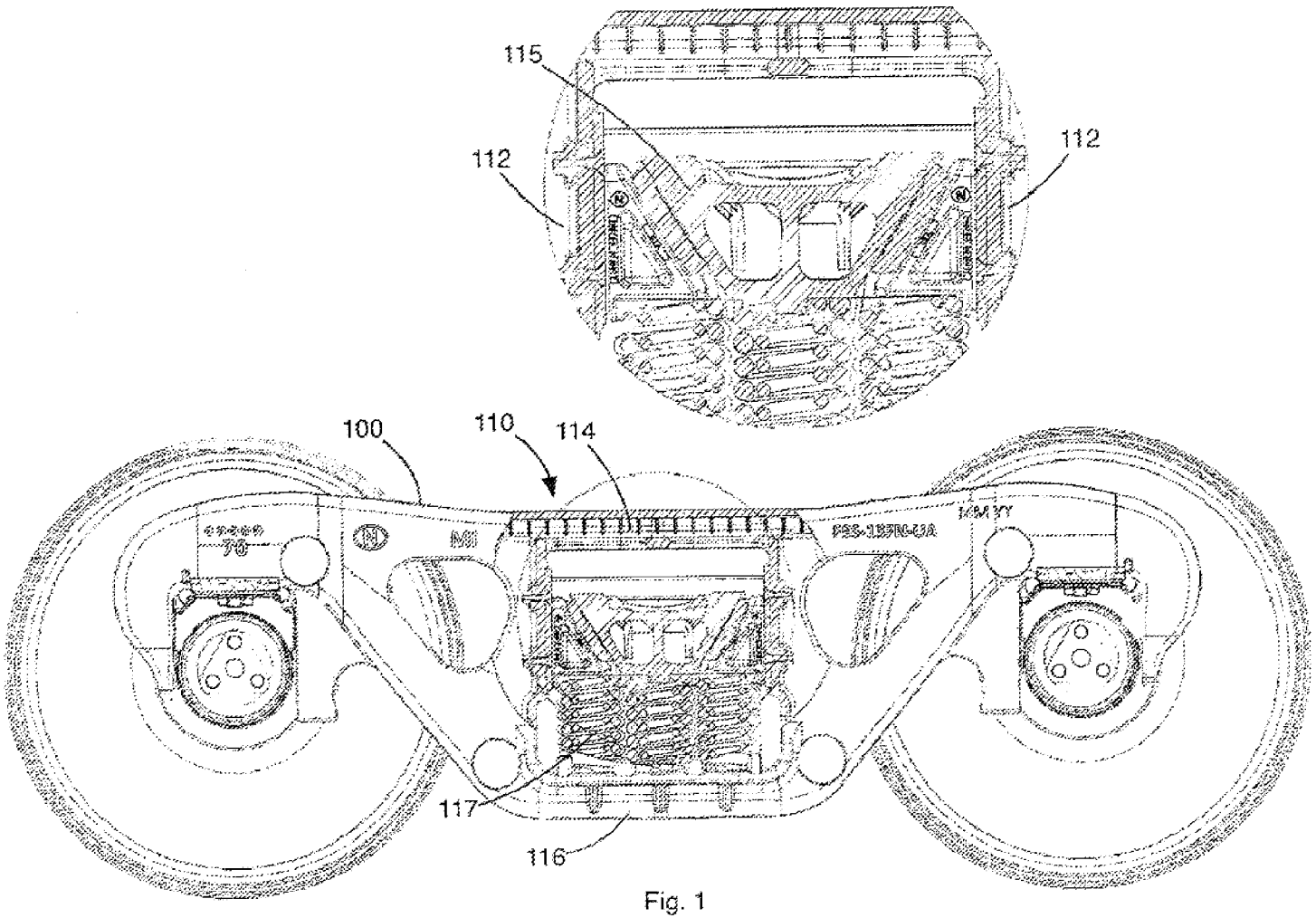
FIG. 1 illustrates a side view of a side frame of a railway car truck along with a cut-away close up view of the bolster opening.

FIG. 1 illustrates a side view of a side frame 100 of a railway car truck. The railway car may correspond to a freight car, such as those Utilized in the United States for carrying cargo in excess of 220,000 lbs. Gross Rail Load. The side frame 100 defines a bolster opening 110.

The bolster opening 110 is defined by a pair of side frame columns 112, a compression member 114, and a spring seat 116. The bolster opening 110 is sized to receive an outboard end section 115 of a bolster, a cut-away of which is illustrated. A group of springs 117 is positioned between the outboard end section 115 of the bolster and the spring seat 116 and resiliently couple the bolster to the side frame 100.

Figure 2:
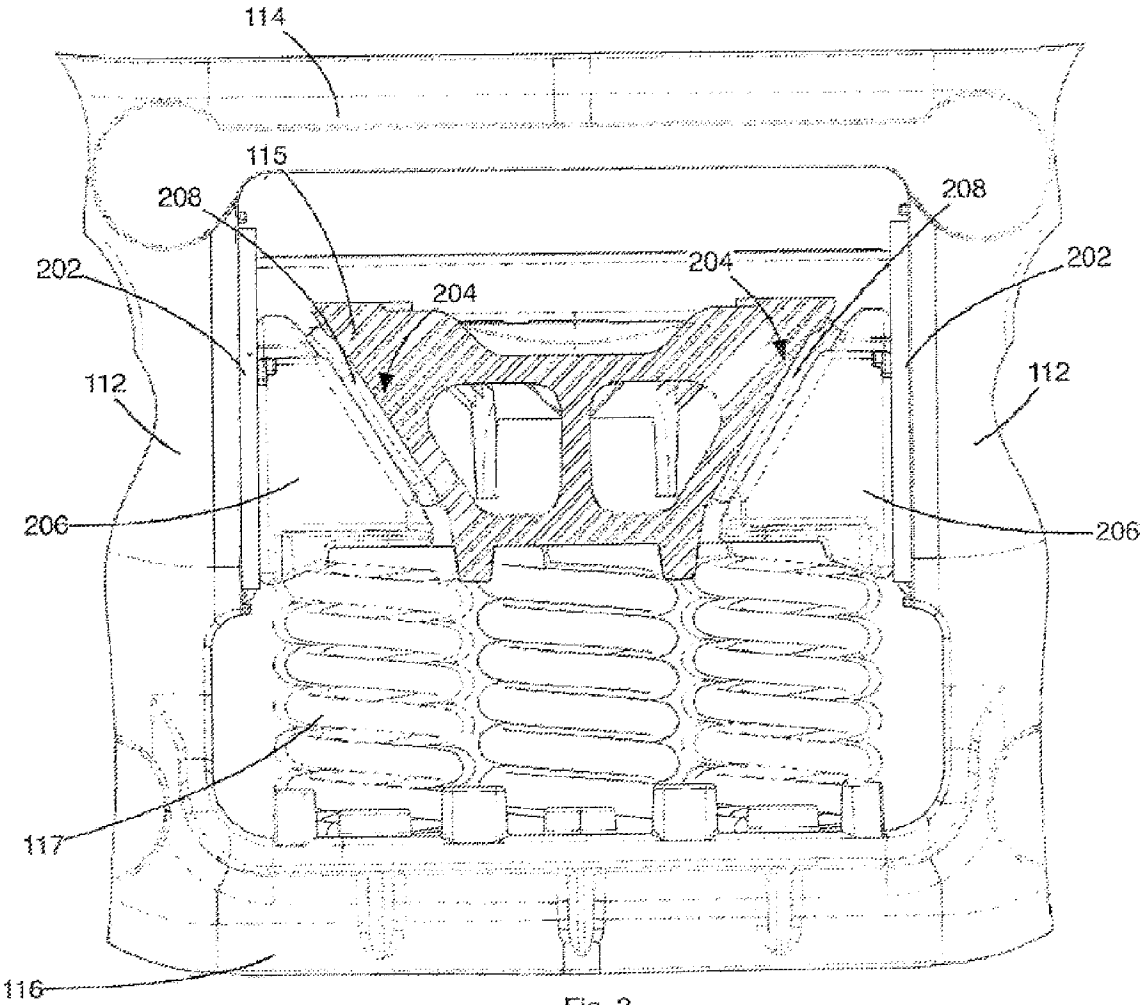
FIG. 2 illustrates a detailed view of a bolster opening of the side frame of FIG. 1 with a cut-away view of the outboard end section of a bolster inserted therein.

Referring to FIG. 2, wear plates 202 are positioned between respective column faces (FIG. 3, 300) of friction wedges 206 and the side frame columns 112. Wedge inserts 208 are positioned between respective sloping faces (FIG. 3, 302) of the friction wedges 206 and shoe pockets 204 of the bolster. During operation, the column face 300 and the sloping face 302 of each friction wedge 206 bear against a corresponding wear plate 202 and wedge insert 208, respectively. The friction wedges 206 slide against the wear plates 202 and wedge inserts 208, creating friction and dissipating energy to function as dampers that prevent sustained oscillation between the side frame 100 and the bolster.

Figure 3:
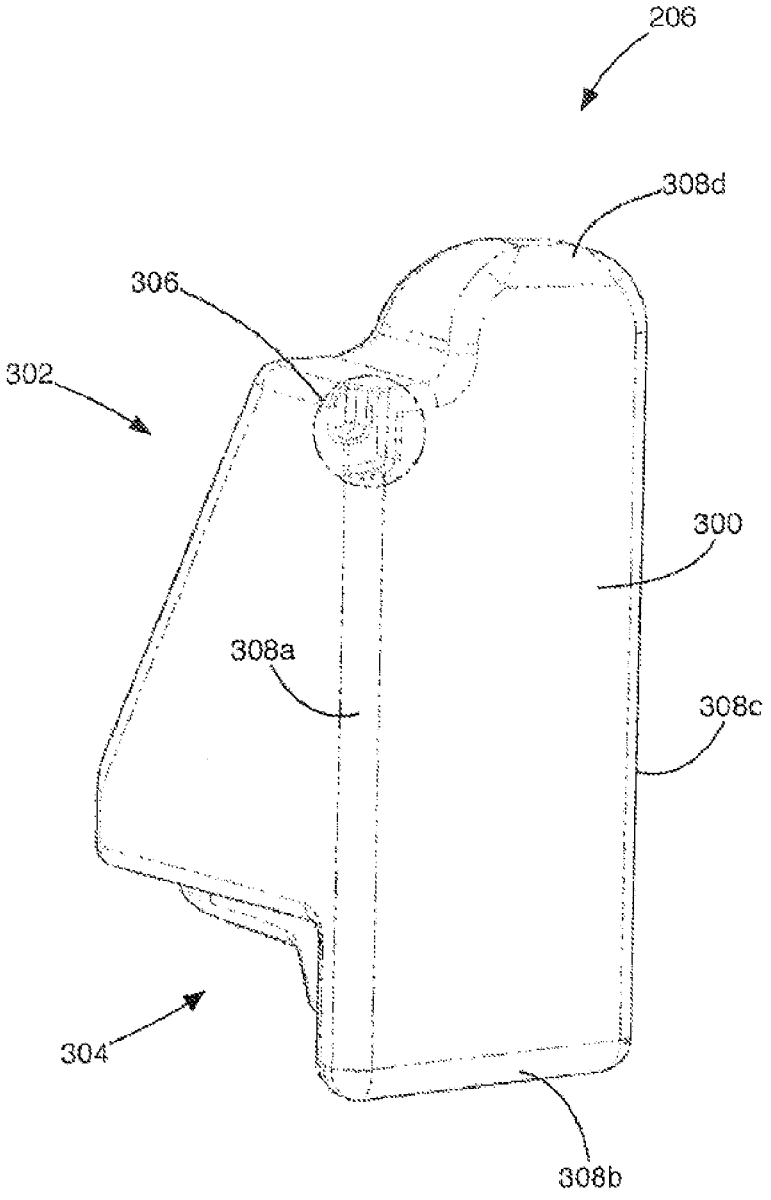
FIG. 3 illustrates a first exemplary friction wedge embodiment.

FIG. 3 illustrates an exemplary friction wedge 206. The friction wedge 206 includes a column face 300, a sloping face 302, and a bottom side 304. A wear indicator 306 is defined on one side of the friction wedge 206. The wear indicator 306 facilitates the determination of the amount of service life left in the friction wedge 206.

Column face edges 308*a-d* are chamfered with a radius that provides for a smooth transition between the column face 300 and adjacent sides of the friction wedge 206. In one implementation, the column face 300 of the friction wage 206 is substantially flat. The radius of the chamfered edges 308*a-d* may be about 0.30 inches. As described in more detail below, the respective edges 308*a-d* are formed with a core rather than after casting by subsequent finishing operations.

Figure 4A:
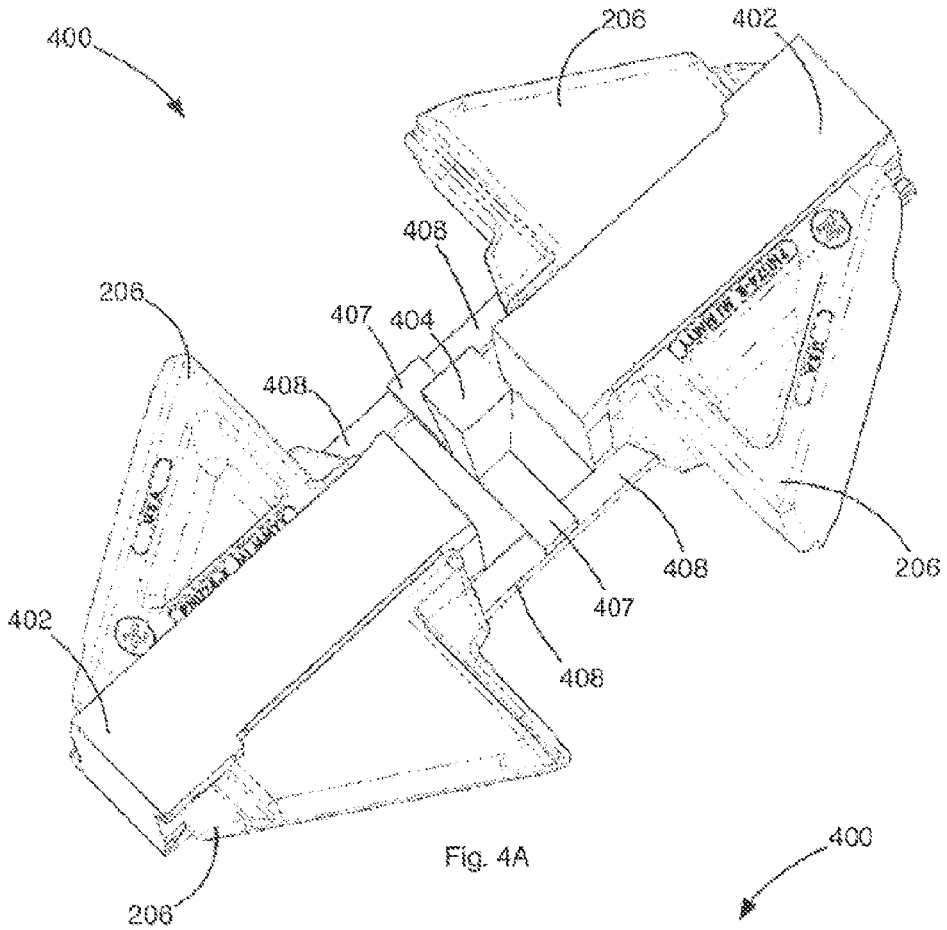
FIGS. 4A and 4B illustrate different views of exemplary rigging that may be provided in a mold to manufacture the friction wedge.
Figure 4B:
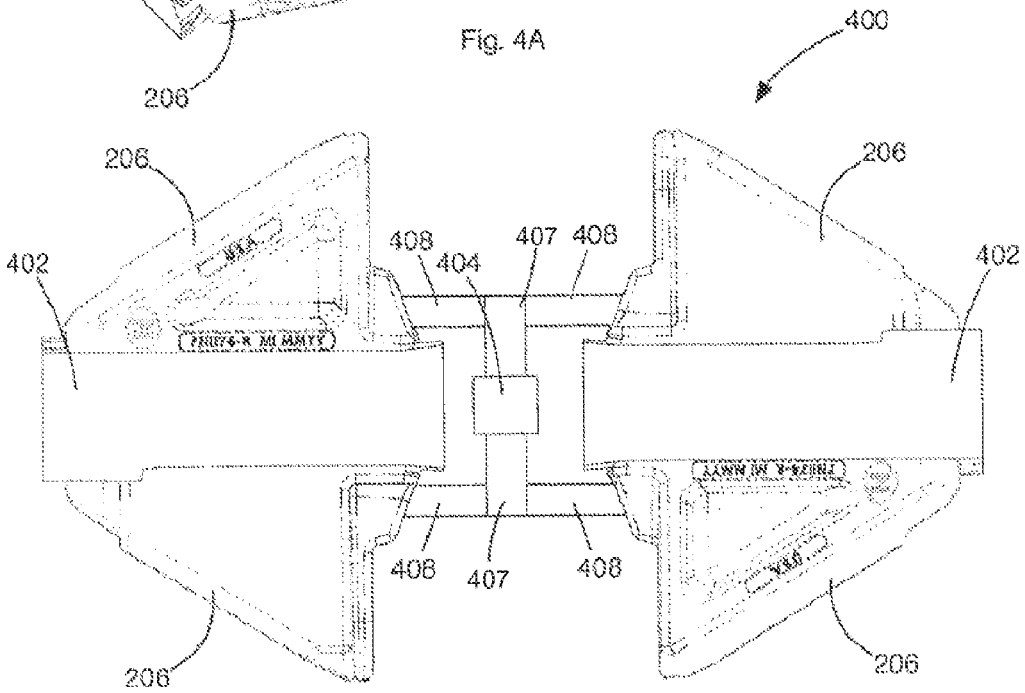

FIGS. 4A and 4B illustrate different views of exemplary rigging 400 that may be provided in a mold (not shown) to manufacture the friction wedges 206, described above. The rigging is typically formed with the patterns (not shown) that are used to form the cavities for the friction wedges 206. It is understood that FIGS. 4A and 4B illustrate exemplary rigging, cores 402, and finished wedges 206 as they would look after a shake-out process. The cope and drag are not shown for clarity. While the exemplary rigging 400 illustrates the manufacture of four friction wedges 206, it is understood that the rigging 400 could be adapted to manufacture a different number of friction wedges 206. Furthermore, the rigging may be adjusted to modify the positions of the down sprue, runners and ingates as necessary. The shape of the down sprue, runners and ingates could also be modified.

Referring to FIGS. 4A and 4B, the rigging 400 includes a down sprue 404 that is connected to ingates 407. The ingates 407 are in turn connected to runners 408. The runners 408 lead to cavities in the mold for forming the exterior shape of the friction wedges 206. In one implementation, the runners 408 are arranged so molten material fills the cavity from a side of the cavity that forms the bottom side 304 of a friction wedge 206, which is a less critical dimension of the friction wedge 206.

Cores 402 are inserted into the mold. The cores 402 form the column face 300 of the respective friction wedges 206. Each core 402 may be utilized to form the face of two friction wedges 206. In alternative implementations the cores 402 could be configured to form faces 300 for a different number of friction wedges 206. For example, a square core (i.e., a core with four sides) could be utilized to form the column faces of four friction wedges 206. It is understood that the number of friction wedges 206 that could be formed by a single core is limited only by the number of sides that the core has.

Figure 5A:
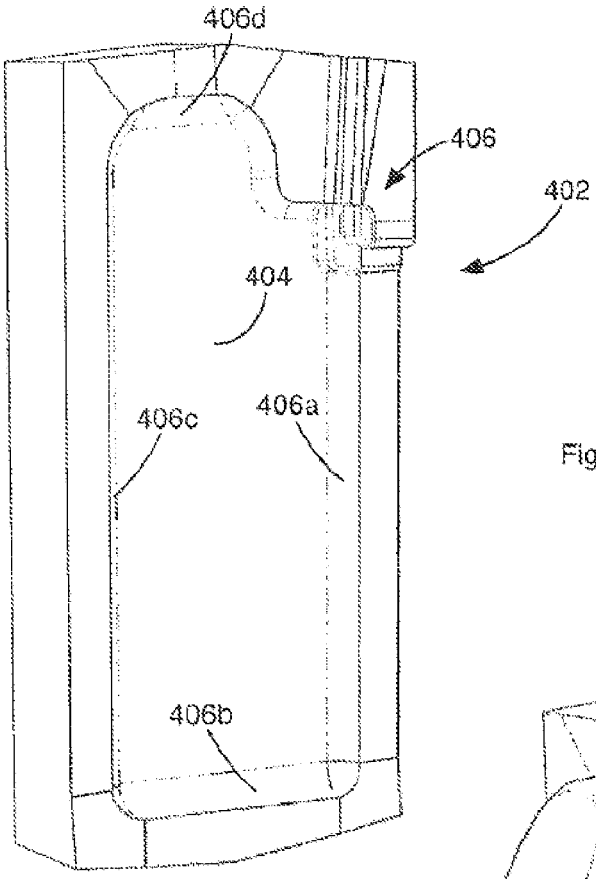
FIG. 5A illustrates details of a core that may be utilized in cooperation with the rigging and mold to form the first friction wedge embodiment.
Figure 5B:
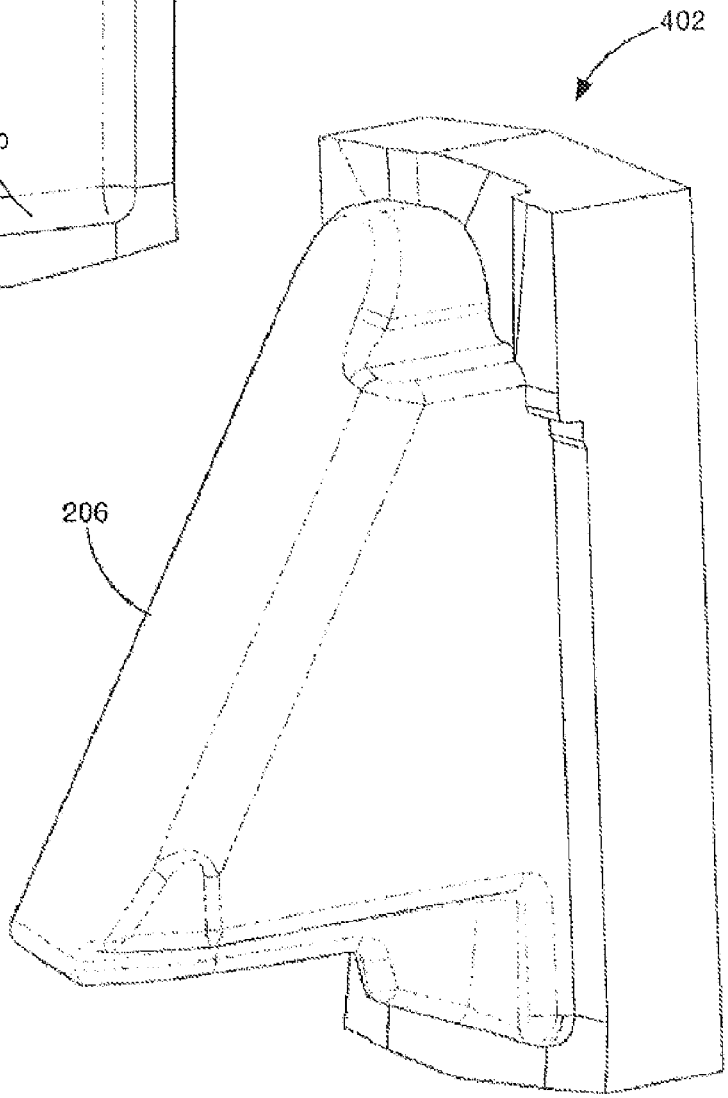
FIG. 5B illustrates the interaction of the core with a completed friction wedge.

FIGS. 5A and 5B illustrate details of the core 402. For clarity, FIG. 5B shows a completed wedge 206 positioned against a core 402 to show the interaction between the core 402 and the finished wedge 206. The core 402 may be an isocure core, no bake core, or shell core. An interior section 404 of the core 402 defines the column face 300 of a friction wedge 206. In one implementation, the interior section is a generally flat surface. Interior edges 406*a-d* define the chamfered column face edges 308*a-d* of the friction wedge 206. The edges 406*a-d* may have a radius of about 0.30 inches. The core 402 also includes a region 406 that forms the wear indicator 306 of the friction wedge 206.

Flatness of the friction wedge 206 is important because the column face 300 of the friction wedge 206 interacts with the wear plate 202, which is a hot rolled steel plate and, therefore, very flat. Forming the column face 300 in the mold (i.e., with green sand) would introduce artifacts as a result of draft angles and parting lines. Without additional finishing, these artifacts would prevent the friction wedge 206 from sitting correctly against the wear plate 202. In an non-illustrated embodiment of the core 402, the interior section 404 and chamfered interior edges 406*a-d* are eliminated in favor of a completely flat face which formed the corresponding column face 300 of the wedge 206. In an additional non-illustrated embodiment of the core 402, the interior section 404 is included without the chamfered interior edges 406*a-d*.

By contrast a core can be made much harder and more accurately than a production green sand mold, creating a higher quality casting surface. The improved surface finish reduces the size of the as-cast asperities in the friction wedge 206. These asperities are removed as the friction wedge 206 slides against the wear plate 202 at initial break-in. The reduction in the size of the asperities reduces the time required to break-in the friction wedge 206, and reduces the size and amount of grit in the assembly. Faster break-in leads to decreased wear and, therefore, longer part life. Less and smaller sizes of grit can eliminate the effects of 3 body wear mechanism's and therefore reduce the wear rate of the system. In some implementations, use of a core facilitates the manufacture of a friction wedge 206 that has a column face 300 with a surface finish less than about 500 micro-inches RMS.

Moreover, defining interior chamfered edges eliminates the need for grinding of on the column face 300 subsequent to casting, which would otherwise create large gouges and scratches, which affect the break-in of the friction wedge 206. Grinding produces other inconsistencies in the casting as well.

Figure 6A:
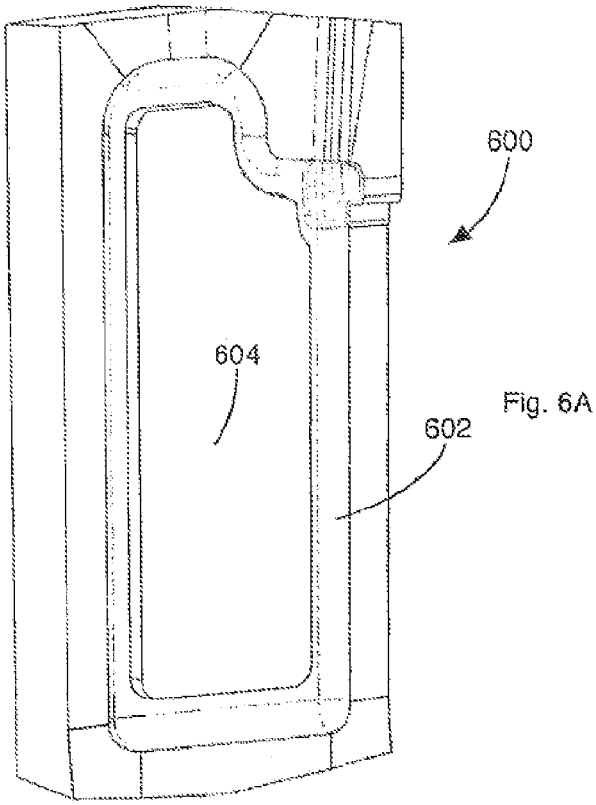
FIGS. 6A and 6B illustrate a second exemplary friction wedge embodiment and a core for manufacturing the same.
Figure 6B:
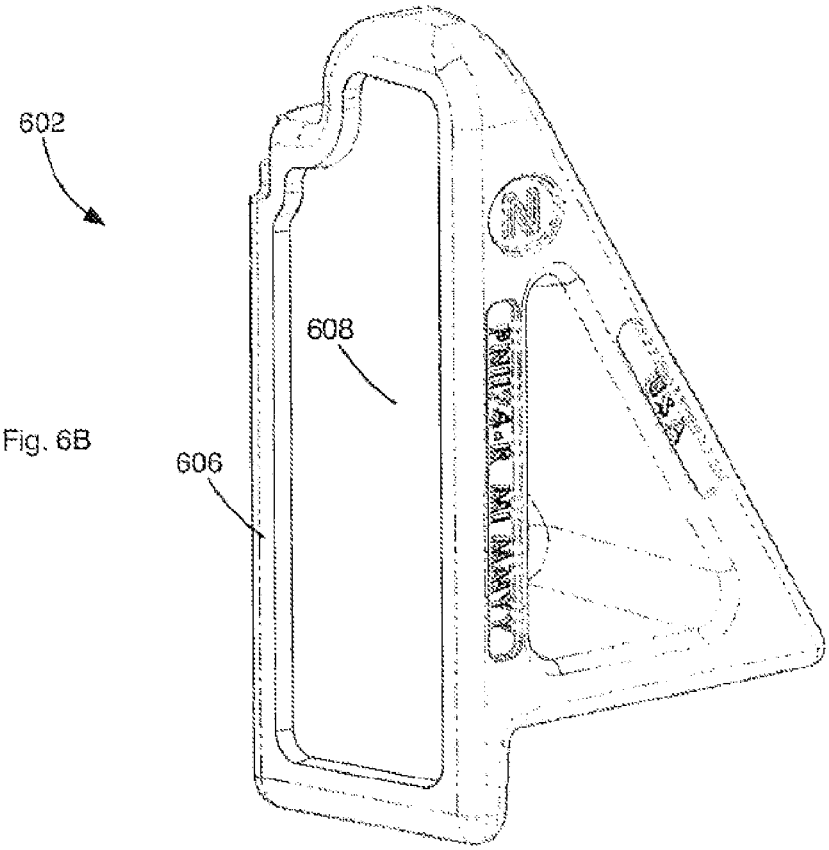

FIGS. 6A and 6B illustrate a second exemplary friction wedge embodiment 602 and a core 600 for manufacturing the same. The core 600 defines a groove 602 around the perimeter of a flat middle section 604. The friction wedge 602 includes a column face that defines a recessed portion 608 and a raised portion 606. The recessed portion 608 is formed by the flat middle section 604 of the core 600. The raised portion 606 is formed by the groove 602. The recess 608 formed in the column face facilities the insertion of a friction control material (not shown), such as a brake shoe material, a clutch material, or other dry friction material. This recess 608 provides a way of capturing and containing an inserted material without the necessity of adhesives, or other bonding techniques.

As with the core described above, the groove 602 forms a radius on the raised portion 606. The radius forms a corresponding radius around the edge of the column face, thus eliminating or substantially reducing the need for finishing (e.g., grinding) of the column face.

Figure 7A:
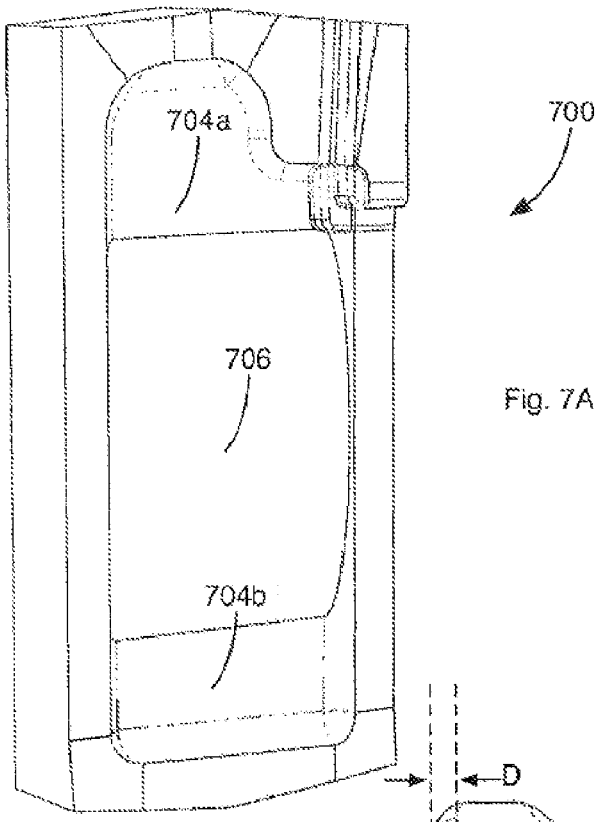
FIGS. 7A and 7B illustrate a third exemplary friction wedge embodiment that defines a concave column face and a core for manufacturing the same.
Figure 7B:
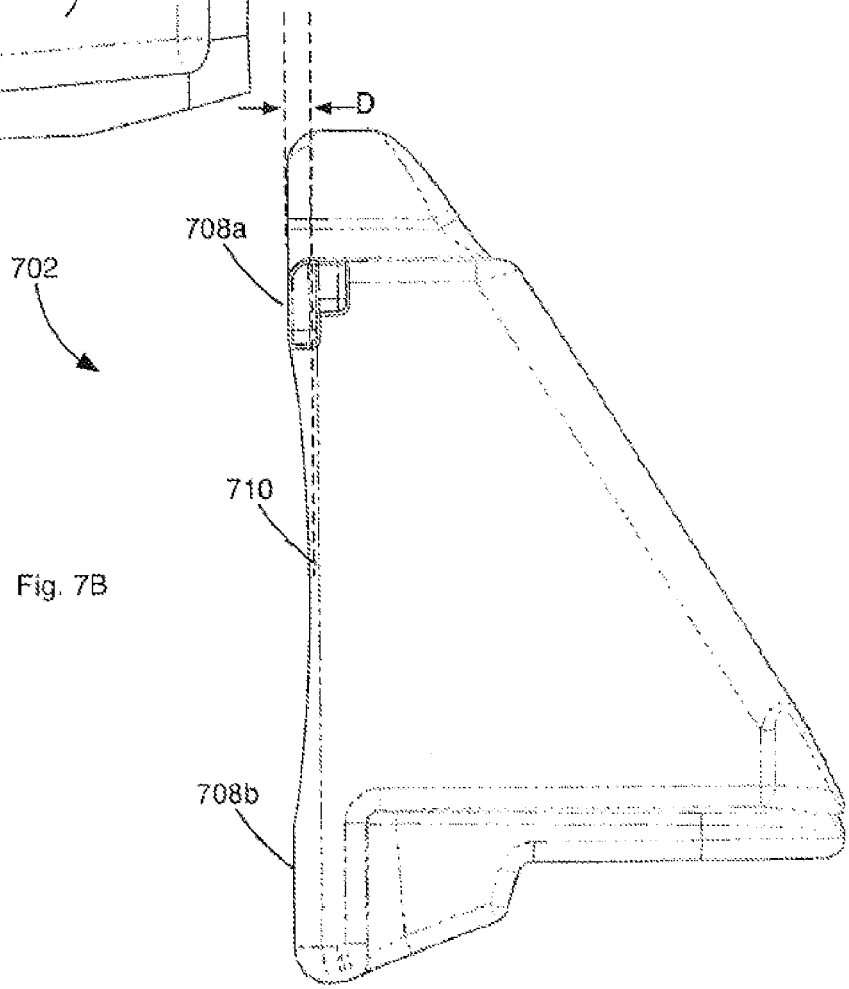

FIGS. 7A and 7B illustrate a third exemplary friction wedge embodiment 702 that defines a concave column face and a core 700 for manufacturing the same. An interior of the core 700 defines top and bottom regions 704*a* and b that are generally flat and lie in substantially the same plane. A middle region 706 is defined between the top and bottom regions 704*ab* and is proud/forward of the top and bottom regions 704*a* and *b*. The middle region 706 may be curved. The top, bottom, and middle regions 704*a* and b and 706 cooperate to form a friction wedge column face with a generally concave middle region 710, and flat top and bottom regions 708*a* and b, as illustrated in FIG. 7B.

Applicant has observed that during servicing, center regions of column faces of known wedges tend to wear less than the top and bottom regions. Similarly, the wear plates 202 exhibit a large amount of wear in the center, and very little wear at the top and bottom. The concave column face of the third friction wedge embodiment 702 results in more even wear between the friction wedge 702 and the wear plate 202. This, in turn, increases the useful service life of the friction wedge 702. Applicant has observed that a recess amount, D, of between 0.020 and 0.060 inches produces an optimal wear evenness over the service life of the friction wedge 702.

It is understood that the recess amount, D, may be different and may be adjusted based on the amount of wear that occurs for a given combination of friction wedge and wear plate 202. In some implementations, a friction control material may be arranged within the recess to control friction levels, and further control wear evenness between the friction wedge and the wear plate 202.

In some implementations, to improve the longevity of the friction wedges, a heat treatment may be applied subsequent to casting. Applicant has observed that the useful service life of the friction wedges may be maximized if the friction wedges are hardened to a hardness between 420-520 BHN, which is generally not achievable with known friction wedge manufacturing methods, such as the method disclosed in U.S. Pat. No. 4,166,756. To achieve this hardness, the friction wedges are heated to a temperature above 1200 F0 after casting. The friction wedges are held at this temperature for a period of time and then rapidly cooled by submerging in a quench media, such as oil, water, or molten salt, which may be at a temperature of between 100° and 500°. The final hardness and microstructure of a friction wedge is determined based on a number of factors that include the temperature of the friction wedge at the time of quenching, the time held at that temperature, the temperature of the quench media, and the alloy of the friction wedge.

Generally, after quenching, the friction wedges become brittle, contain residual stresses, and are unfit for service. Tempering is used to further refine the microstructure, restore ductility, increase toughness, and relieve the residual stresses. Tempering is typically carried out by heating the friction wedges to a prescribed temperature, then slowly cooling them at a prescribed rate.

In one implementation, the friction wedges comprise an iron alloy that includes Copper and/or Nickel. In this case, after quenching and tempering, the resulting alloy exhibits an acicular gray iron microstructure that comprises predominantly Bainite and Martensite, with some retained Austenite, traces of Carbide, and no more than 5% Pearlite.

While various embodiments of the embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

I claim:

1. A railcar truck comprising:

a bolster having an outboard end section, the outboard end section having first and second shoe pockets;

a side frame including a bolster opening defined by a pair of side frame columns, a compression member, and a spring seat, the bolster opening sized to receive the outboard end section of the bolster a group of springs, the group of springs positioned between the outboard end section of the bolster and the spring seat, the group of springs resiliently coupling the bolster to the side frame;

a first friction wedge and a second friction wedge, each friction wedge comprising:

a column face, the column face having chamfered edges providing a smooth transition between the column face and adjacent sides of the friction wedge;

a sloping face;

a bottom side; and a wear indicator on a side of the friction wedge;

a first wear plate and a second wear plate, each wear plate positioned between the respective column faces of the friction wedges and the respective side frame columns a first wedge insert and a second wedge insert, each wedge insert positioned between the respective sloping faces of the friction wedges and the respective shoe pockets;

wherein the column face as-cast, without further finishing, of each of the friction wedges is substantially flat and has a surface finish less than 500 micro-inches RMS wherein each of the friction wedges has an acicular gray iron microstructure that comprises Bainite, Martensite, Austenite, Carbide, and no more than about 5% Pearlite; and wherein each of the friction wedges has a hardness of between 420-520 BHN.

2. The rail car truck of claim 1, wherein the chamfered edges of each of the first and second friction wedges have a radius of about 0.30 inches.

3. A friction wedge of a rail car comprising:

a column face, the column face having chamfered edges providing a smooth transition between the column face and adjacent sides of the friction wedge;

a sloping face;

a bottom side; and a wear indicator on a side of the friction wedge;

wherein the column face as-cast, without further finishing, has a surface finish less than 500 micro-inches RMS.

4. The friction wedge of claim 3, wherein the column face is substantially flat.

5. The friction wedge of claim 4, wherein the friction wedge has an acicular gray iron microstructure that comprises Bainite, Martensite, Austenite, Carbide, and no more than about 5% Pearlite.

6. The friction wedge of claim 5, wherein the friction wedge has a hardness of between 420-520 BHN.

7. The friction wedge of a rail car of claim 6, wherein the chamfered edges have a radius of about 0.30 inches.

8. The friction wedge of claim 3, wherein the column face has substantially flat top and bottom regions and a concave middle region, and wherein a maximum distance between a plane within which the top and bottom flat regions are disposed and an apex of the concave middle region is between 0.020 and 0.060 inches.

9. The friction wedge of claim 3, wherein the column face comprises a recessed portion.

10. The friction wedge of claim 3, wherein the column face comprises a substantially flat middle region surrounded by a groove defined in the column face.

11. The friction wedge of claim 10, wherein the groove has a depth of about 0.06 inches.

12. The friction wedge of claim 11, wherein the recessed portion includes a friction control material.

13. A friction wedge of a rail car comprising:

a column face, the column face having chamfered edges providing a smooth transition between the column face and adjacent sides of the friction wedge;

a sloping face;

a bottom side; and a wear indicator on a side of the friction wedge;

wherein the column face as-cast, without further finishing, has a surface finish less than 500 micro-inches RMS; and wherein the friction wedge has an acicular gray iron microstructure that comprises Bainite, Martensite, Austenite, Carbide, and no more than about 5% Pearlite.

14. The friction wedge of claim 13, wherein the friction wedge has a hardness of between 420-520 BHN.

15. The friction wedge of claim 14, wherein the column face is substantially flat.

16. The friction wedge of a rail car of claim 15, wherein the chamfered edges have a radius of about 0.30 inches.

17. The friction wedge of claim 13, wherein the column face has substantially flat top and bottom regions and a concave middle region, and wherein a maximum distance between a plane within which the top and bottom flat regions are disposed and an apex of the concave middle region is between 0.020 and 0.060 inches.

18. The friction wedge of claim 13, wherein the column face comprises a recessed portion.

19. The friction wedge of claim 13, wherein the column face comprises a substantially flat middle region surrounded by a groove defined in the column face.

20. The friction wedge of claim 19, wherein the groove has a depth of about 0.06 inches.

21. The friction wedge of claim 20, wherein the recessed portion includes a friction control material.

* * * * *